US008587205B2

(12) United States Patent
Ter Weeme et al.

(10) Patent No.: US 8,587,205 B2
(45) Date of Patent: Nov. 19, 2013

(54) LED LIGHTING WITH INCANDESCENT LAMP COLOR TEMPERATURE BEHAVIOR

(75) Inventors: Berend Jan Willem Ter Weeme, Eindhoven (NL); William Peter Mechtildis Marie Jans, Eindhoven (NL); Theo Gerrit Zijlman, Eindhoven (NL); Gazi Akdag, Eindhoven (NL); Erik Martinus Hubertus Petrus Van Dijk, Eindhoven (NL); Paul Johannes Marie Julicher, Eindhoven (NL); Bertrand Johan Edward Hontele, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/255,956

(22) PCT Filed: Mar. 11, 2010

(86) PCT No.: PCT/IB2010/051053

§ 371 (c)(1), (2), (4) Date: Dec. 22, 2011

(87) PCT Pub. No.: WO2010/103480

PCT Pub. Date: Sep. 16, 2010

(65) Prior Publication Data

US 2012/0134148 A1 May 31, 2012

(30) Foreign Application Priority Data

Mar. 12, 2009 (EP) ..... 09154950

(51) Int. Cl.
*F21V 9/00* (2006.01)
*H05B 37/00* (2006.01)

(52) U.S. Cl.
USPC ..... 315/185 R; 362/227; 362/249.02; 362/372; 362/800; 362/231; 315/113; 315/160; 315/291; 315/309

(58) Field of Classification Search
USPC ..... 315/113, 160, 185 R, 291, 307, 309; 362/231, 227, 249.02, 372, 800
See application file for complete search history.

(56) References Cited

U.S. PATENT DOCUMENTS 5,803,579 A * 9/1998 Turnbull et al. ..... 362/516
7,504,781 B2 * 3/2009 Wendt et al. ..... 315/291

(Continued)

FOREIGN PATENT DOCUMENTS

DE 10230105 A1 1/2003
WO 2007093927 A1 8/2007

(Continued)

*Primary Examiner* — Douglas W Owens
*Assistant Examiner* — Thai Pham
(74) *Attorney, Agent, or Firm* — John F. Salazar; Mark L. Beloborodov

(57) ABSTRACT

In a lighting device, sets of LEDs are employed using the natural characteristics of the LEDs to resemble incandescent lamp behavior when dimmed, thereby obviating the need for sophisticated controls. A first set of at least one LED produces light with a first color temperature, and a second set of at least one LED produces light with a second color temperature. The first set and the second set are connected in series, or the first set and the second set are connected in parallel, possibly with a resistive element in series with the first or the second set. The first set and the second set differ in temperature behavior, or have different dynamic electrical resistance. The light device produces light with a color point parallel and close to a blackbody curve.

12 Claims, 9 Drawing Sheets

(56) References Cited

U.S. PATENT DOCUMENTS

| | | | | |
|---|---|---|---|---|
| 2002/0048177 | A1 | 4/2002 | Rahm et al. | |
| 2002/0070681 | A1* | 6/2002 | Shimizu et al. | 315/246 |
| 2003/0067773 | A1 | 4/2003 | Marshall et al. | |
| 2006/0202915 | A1* | 9/2006 | Chikugawa | 345/46 |
| 2006/0243986 | A1 | 11/2006 | Wall, Jr. | |
| 2006/0273331 | A1 | 12/2006 | Lim et al. | |
| 2007/0080652 | A1 | 4/2007 | Elferich et al. | |
| 2008/0224631 | A1 | 9/2008 | Melanson | |
| 2009/0251882 | A1 | 10/2009 | Ratcliffe | |
| 2010/0066258 | A1* | 3/2010 | Yasuda | 315/186 |
| 2011/0068702 | A1* | 3/2011 | van de Ven et al. | 315/186 |

FOREIGN PATENT DOCUMENTS

| | | | |
|---|---|---|---|
| WO | 2008084771 | A1 | 7/2008 |
| WO | 2009104136 | A1 | 8/2009 |

* cited by examiner

LED LIGHTING WITH INCANDESCENT LAMP COLOR TEMPERATURE BEHAVIOR

FIELD OF THE INVENTION

The present invention relates in general to a lighting device comprising a plurality of LEDs as light sources and having only two terminals for receiving power, and more specifically to a LED lighting device having an incandescent lamp color temperature behavior when dimmed. The invention further relates to a kit of parts comprising a LED lighting device and a dimming device.

BACKGROUND OF THE INVENTION

A traditional light bulb is an example of a lighting device comprising a light source, i.e. the lamp filament, having two terminals for receiving power. When a voltage is applied to such light bulb, a current flows through the filament. The temperature of the filament rises due to Ohmic heating. The filament generates light, having a color temperature related to the temperature of the filament, which may be considered as being a black body. Normally, a lamp has a nominal rating corresponding to a nominal lamp power at nominal lamp voltage, for instance 230 VAC in Europe, and corresponding to a certain nominal color of the emitted light.

Since many decades, people have been used to the light of incandescent lamps of different powers. The light of an incandescent lamp provides a general feeling of well-being. Generally, the lower the power of the incandescent lamp is, the lower the color temperature of the light emitted by the lamp is. As a characterization, the human perception of the light is "warmer" when the color temperature is lower. With one and the same incandescent lamp, the lower the power supplied to the lamp is, which occurs when the lamp is dimmed, the lower the color temperature of the emitted light is.

It is already known that it is possible to dim a lamp, i.e. to reduce the light output. This is done by reducing the average lamp power by reducing the average lamp voltage, for instance by phase cutting. As a result, also the temperature of the filament reduces, and consequently the color of the emitted light changes to a lower color temperature. For instance, in a standard incandescent lamp having 60 W nominal rating, the color temperature is about 2700 K when the lamp is operated at 100% light output while the color temperature is reduced to about 1700 K when the lamp is dimmed to a 4% light output. As is commonly known to a person skilled in the art, the color temperature follows the traditional black body line in a chromaticity diagram. A lower color temperature corresponds to a more reddish impression, and this is associated with a warmer, more cozy and pleasant atmosphere.

A relatively recent tendency is to replace incandescent light sources by lighting devices based on LED light sources, in view of the fact that LEDs are more efficient in converting electric energy to light and have a longer lifetime. Such lighting device comprises, apart from the actual LED light source(s), a driver that receives the mains voltage intended to operate an incandescent lamp and converts the input mains voltage to an operating LED current. LEDs are designed to provide a nominal light output when operated with a constant current having a nominal magnitude. An LED can also be dimmed. This can be done by reducing the current magnitude, but this typically results in a change of the color of the light output. In order to keep the color temperature of the generated light as constant as possible, dimming an LED is typically done by Pulse Width Modulation, also indicated as duty cycle dimming, wherein the LED current is switched ON and OFF at a relatively high frequency, wherein the current magnitude in the ON periods is equal to the nominal design magnitude, and wherein the ratio between ON time and switching period determines the light output.

It is desirable to have a lighting device having one or more LEDs as light source, wherein the dimming behavior of the traditional incandescent lamp is simulated so that, on dimming, the color temperature of the output light also follows a path (preferably close to the black body line) from a higher color temperature to a lower temperature.

Lighting devices capable of such functionality have already been proposed, for instance in US-2006/0273331. Such prior art devices comprise at least two LEDs of mutually different colors, each provided with a corresponding current source, and an intelligent control device, such as a microprocessor, controlling the individual current sources to change the relative light outputs of the respective LEDs. The known device receives an input voltage signal that carries power and a control signal. In the device, the control signal is taken from the input signal and transferred to the intelligent control device, that controls the individual current sources on the basis of the received control data. By changing the ratio between the respective light outputs, the relative contributions to the overall light output is changed and hence the overall color of the overall light output, as perceived by an observer, is changed. Such lighting device, therefore, requires a separate control input signal.

In LED lighting devices, a behavior of the color temperature of the LED light can be obtained which, in dimming conditions, is similar to that of an incandescent lamp, but until now only at the expense of extensive current control, such as e.g. known from DE10230105. The necessity of adding controls to the LED lighting device for the desired color temperature behavior increases the number of components, increases the complexity of the lighting device, and increases costs. These effects are undesirable.

SUMMARY OF THE INVENTION

The present invention aims to provide a LED circuit for such LED lighting device, and a LED lighting device comprising such LED circuit, wherein an intelligent control can be omitted and wherein a feedback sensor can be omitted.

It would be desirable to provide an LED lighting device having a color temperature behavior, when dimmed, resembling or approaching the color temperature behavior of an incandescent lamp, when dimmed. It would also be desirable to provide an LED lighting device having an incandescent lamp color temperature behavior, when dimmed, without the need of extensive controls.

According to an aspect of the present invention, an LED lighting device comprises a single dimmable current source and an LED module receiving current from the current source. The LED module behaves as a load to the current source, similar to an array existing of LEDs only. Within the LED module, an electronic circuit senses the current magnitude of the input current, and distributes the current to different LED sections of the LED module on the basis of the sensed current magnitude. No intelligent current control is needed in the current source.

To better address one or more of these concerns, in an aspect of the invention an LED lighting device is provided, comprising a plurality of LEDs, and two terminals for supplying current to the lighting device. The lighting device comprises a first set of at least one LED of a first type producing light having a first color temperature, and a second set of at least one LED of a second type producing light having a second color temperature different from the first color temperature. The first set and the second set are connected in series or in parallel between the terminals. The lighting device is configured to produce light with a color point varying in accordance with a blackbody curve at a variation of an average current supplied to the terminals.

A color temperature behavior of an incandescent lamp may be described by the following relationship:

$$CT(x\%)=CT(100\%)*(x/100)1/9.5$$

where CT(100%) is the color temperature of the light at full power (100% current) of the lamp, CT(x %) is the color temperature of the light at x % dimming of the lamp (x % current, with $0 \leq x \leq 100$).

In an embodiment, the first set has a varying first luminous flux output as a function of junction temperature of the LED of the first type, and the second set has a varying second luminous flux output as a function of junction temperature of the LED of the second type, and wherein, at varying junction temperatures, the ratio of the first luminous flux output to the second luminous flux output varies. In particular, when the first color temperature is lower than the second color temperature, the lighting device is configured such that, at decreasing junction temperatures, the ratio of the first luminous flux output to the second luminous flux output increases, and vice versa. In such a configuration, e.g. having the first set connected in series with the second set, the first luminous flux output increases relative to the second flux output when the lighting device is dimmed, thereby producing light having a lower color temperature.

In an embodiment, the first set has a first dynamic electrical resistance, and the second set has a second dynamic electrical resistance. When e.g. the first set is connected in parallel with the second set, different luminous flux outputs of the first set and the second set result, which can be designed to produce light having a lower color temperature when dimmed.

In another aspect of the present invention, a lighting kit of parts is provided, comprising a dimmer having input terminals adapted to be connected to an electrical power supply, and having output terminals adapted to provide a variable electrical power. An embodiment of the lighting device according to the present invention has terminals configured to be connected to the output terminals of the dimmer.

Further advantageous elaborations are mentioned in the dependent claims.

BRIEF DESCRIPTION OF THE DRAWINGS

These and other aspects, features and advantages of the present invention will be further explained by the following description of one or more preferred embodiments with reference to the drawings, in which same reference numerals indicate same or similar parts, and in which.

DETAILED DESCRIPTION OF THE INVENTION

Figure 1A:
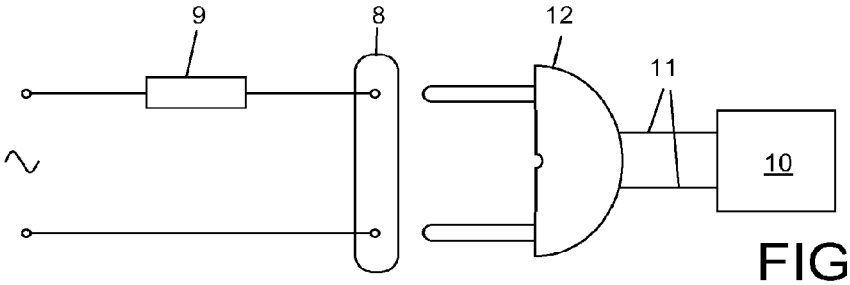
FIGS. 1A-1D are block diagrams schematically illustrating the present invention.

FIG. 1A schematically shows a lighting device 10, having a power cord 11 and power plug 12 connected to a wall socket 8, that receives dimmed mains voltage from a dimmer 9 connected to mains M, for instance 230 VAC @ 50 Hz in Europe. It is noted that instead of a wall socket 8 and power plug 12, the lighting device 10 may also be connected through fixed wiring directly. Conventionally, the lighting device 10 comprises one or more incandescent lamps.

Figure 1B:
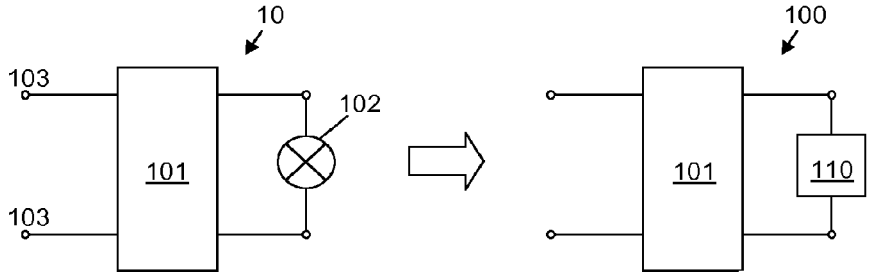

FIG. 1B at the lefthand side shows the conventional layout of a lighting device 10 having LEDs as a light source. Such device comprises a driver 101 that generates current for an LED array 102. The driver 101 has input terminals 103 for receiving mains power. In conventional systems, the driver can only be switched on or off. In a more sophisticated system, the driver 101 is adapted to receive dimmed mains voltage from the dimmer 9, and to generate pulsed output current for the LEDs, the pulse height being equal to a nominal current level while the average current level is reduced on the basis of the dim information contained in the dimmed mains voltage. At the righthand side, FIG. 1B shows a lighting device 100 according to the present invention in which the LED array 102 is replaced by an LED module 110; as seen from the driver 101, the LED module 110 behaves as an LED array, i.e. the load characteristics of the LED module are the same as or similar to the load characteristics of an LED array.

Figure 1C:
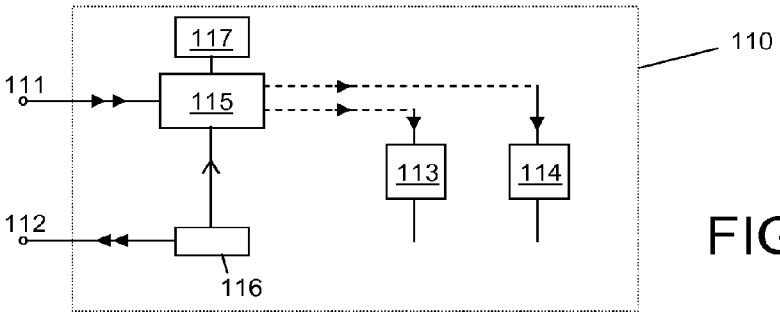

FIG. 1C is a block diagram schematically illustrating the basic concept of the LED module 110 according to the present invention. The module 110 has two input terminals 111, 112 for receiving the LED current from the driver 101. The module 110 comprises at least two LED arrays 113, 114. Each LED array may consist of one single LED or may comprise two or more LEDs. In the case of an LED array comprising a plurality of LEDs, such LEDs may be all connected in series but it is also possible to have LEDs connected in parallel. Further, in the case of an LED array comprising a plurality of LEDs, such LEDs may all be of the same type and/or the same color, but it is also possible that the plurality involves LEDs of mutually different colors. It is seen that in the schematic drawing of FIG. 1C only two LED arrays are shown, but it is noted that the LED module may comprise more than two LED arrays. It is further noted that such arrays may be connected in series and/or in parallel. The module 110 further comprises a division circuit 115 providing drive current to the LED arrays 113, 114, these drive currents being derived from the input LED current as received from the driver 101. The division circuit 115 is provided with a current sensor means 116, sensing the input LED current and providing the division circuit 115 with information representing the momentary average input current. This sensor means 116 may be a separate sensor external to the division circuit 115, as shown, but it may also be an integral part of the division circuit 115. The magnitudes of the individual drive currents for the respective LED arrays 113, 114 depend on the momentary average input current, and more particularly the ratio between the individual drive currents in the respective LED arrays 113, 114 depends on the momentary average input current. To this end, the division circuit 115 may be provided with a memory 117, either external to the division circuit 115, as shown, or an integral part of the division circuit 115, containing information defining a relationship between total input current and current division ratio. The information may for instance be in the form of a function or look-up table, where the division circuit 115 includes an intelligent control means such as for instance a microprocessor. However, in a cost-efficient embodiment preferred by the present invention, the division circuit 115 consists of an electronic circuit with passive and/or active electronic components, supplied by the voltage drop over the LEDs, and the memory function is implemented in the design of the electronic circuit.

Figure 2A:
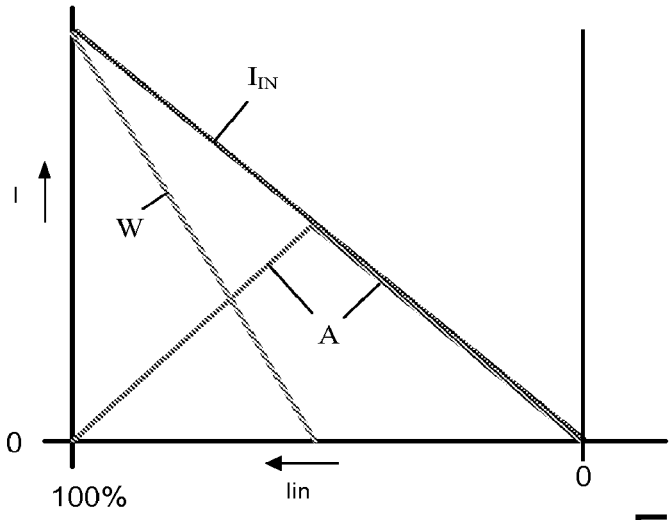
FIGS. 2A and 2B are graphs illustrating the current division behavior of a division circuit according to the present invention.
Figure 2B:
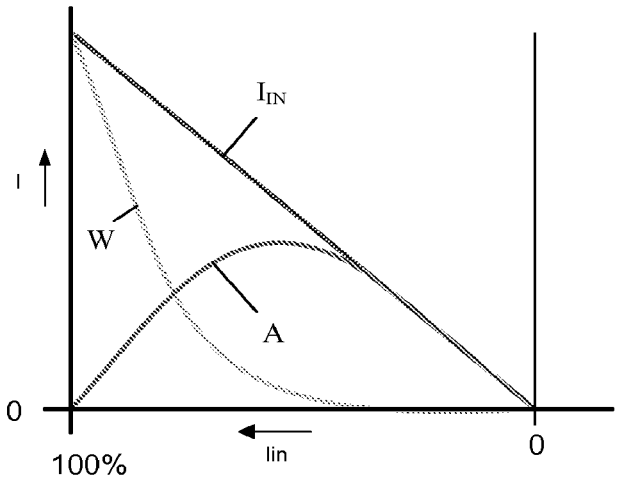

FIGS. 2A and 2B are graphs illustrating an example of the current division behavior of a possible embodiment of the division circuit 115, where the formulas $I1=p \cdot Iin$ and $I2=q \cdot Iin$ apply, with I1 denoting the current in the first LEDs (white) and I2 denoting the current in the second LEDs (amber). Neglecting the current consumption in the division circuit itself, $p+q=1$ at all times. The horizontal axis represents the input current Iin received from the driver 101. The vertical axis represents the output current provided to the LED arrays 113, 114. Assume that the LEDs in one string, for instance the first string 113, are white LEDs and that the LEDs in the other string are amber LEDs. Curve W represents the current in the white LEDs and curve A represents the current in the amber LEDs. FIG. 2A illustrates a linear behavior, while FIG. 2B illustrates an example of a non-linear behavior; it should be clear that other embodiments are also possible. In all cases, the summation of the currents in both strings is almost equal to the input current Iin, represented by a straight line, although the division circuit itself may also consume a small amount of current but this is neglected for sake of discussion. The figures show that when the input current Iin is maximal, all current goes to the white LEDs and the amber LEDs are off. When the input current Iin is reduced, the percentage of the current in the white LEDs reduces and the current through the amber LEDs increases. As from a certain input current level, all current goes to the amber LEDs and the white LEDs are off. Since the color point of the output light is determined by the overall contribution of all LEDs in all strings, it should be clear that the color point is white when the input current Iin is maximal, and that the color point gets warmer with reducing input current.

More generally, when Iin is zero or close to zero, p is equal to a minimum value Pmin which may be equal to zero and q is equal to a maximum value Qmax which may be equal to one. When Iin is at a predetermined nominal (or maximum) level, q is equal to a minimum value Qmin which may be equal to zero and p is equal to a maximum value Pmax which may be equal to one. There is at least a range of input currents where $dp/d(Iin)$ is always positive and $dq/d(Iin)$ is always negative. There may be a range of input currents where p and q are constant. There may be a range of input currents where $p=0$. There may be a range of input currents where $q=0$.

Figure 1D:
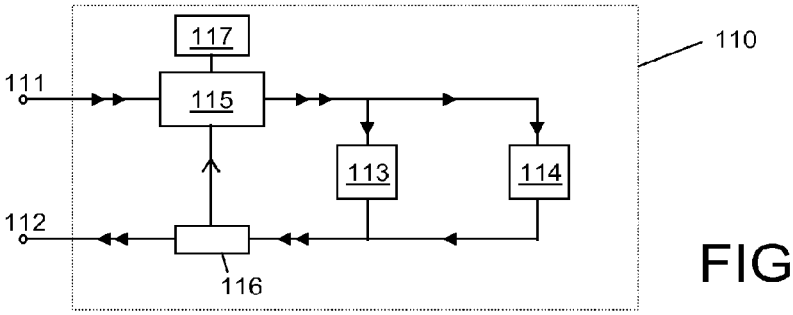

In accordance with the present invention, the important issue is that the division circuit is capable of individually changing the current in at least one LED array. There are several ways possible for doing so. For instance, it may be that the two arrays 113, 114 are arranged in parallel, and that the input current is split into a first portion going to first array 113 and a second portion going to second array 114, as illustrated in FIG. 1D. The summation of the first and second portion may always be equal to the input current. Splitting the current may be done on a magnitude basis, so that each array receives constant current yet of a variable magnitude; this can for instance be achieved if the division circuit comprises at least one controllable resistance or at least one controllable current source in series with an LED array concerned. Splitting the current may also be done on a temporal basis, so that each array receives current pulses with constant magnitude yet of a variable pulse duration; this can for instance be achieved if the division circuit comprises at least one controllable switch in series with an LED array. It may be that a third load (for instance a resistor) is used for dissipating a third portion of the input current bypassing an LED array. It may be that one current portion is kept constant.

The following contains illustrative examples of exemplary implementations embodying the present invention, but it is noted that these examples are not considered to be limiting for the invention. It is noted that in the following only the LED module will be shown; the driver 101 will be omitted for sake of simplicity, since the driver 101 may be implemented by a standard LED driver.

Figure 3A:
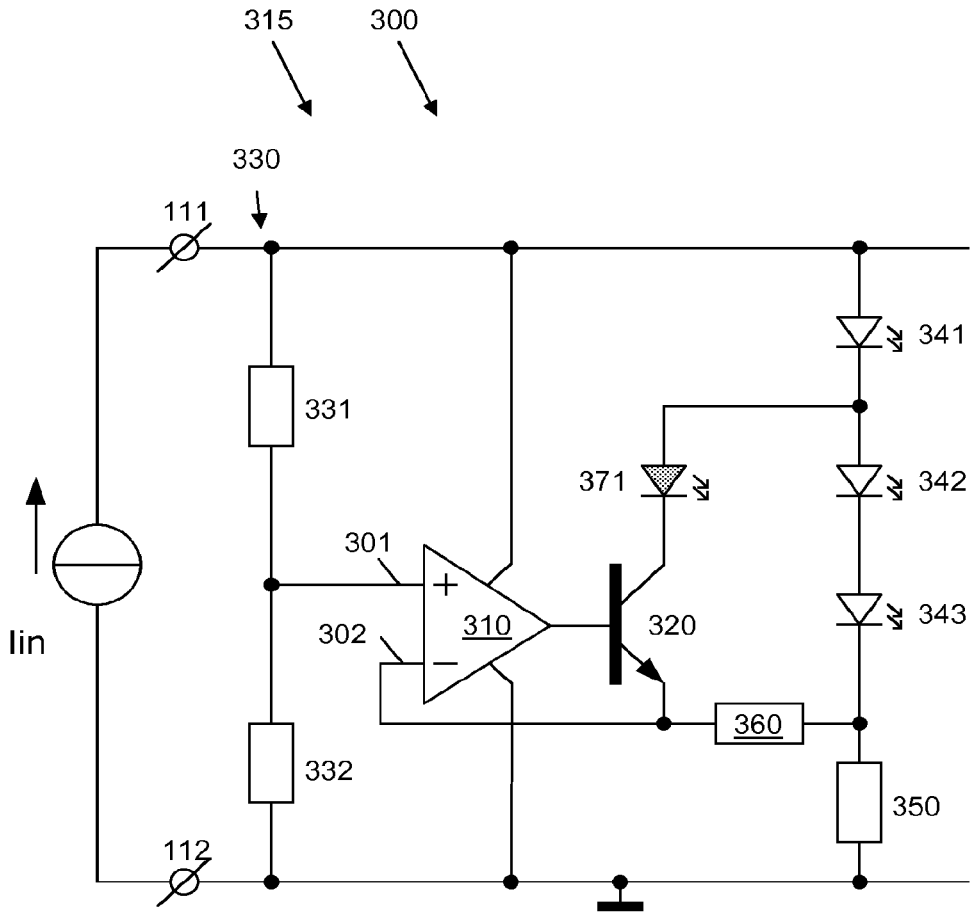
FIG. 3A is a diagram illustrating a first possible embodiment of a division circuit according to the present invention.

FIG. 3A is a diagram illustrating a first possible embodiment of the division circuit 115. This embodiment of the LED module will be indicated by reference numeral 300, and its division circuit will be indicated by reference numeral 315. The division circuit 315 comprises an opamp 310 and a transistor 320 having its base terminal coupled to the output of opamp 310, possibly via a resistor not shown. The opamp 310 has a non-inverting input 301 set at a reference voltage level determined by a voltage divider 330 consisting of a series arrangement of two resistors 331, 332 connected between the input terminals 111, 112, said non-inverting input 301 being coupled to the node between said two resistors 331, 332. The LED module 300 further comprises a string of three white LEDs 341, 342, 343 arranged in series between the input terminals 111, 112, with a resistor acting as current sensor 350 arranged in series with the string of white LEDs. A feedback resistor 360 has one terminal connected to the node between current sensor resistor 350 and the string of white LEDs 341, 342, 343, and has its second terminal connected to an inverting input of the opamp 310. The transistor 320 has its emitter terminal connected to the inverting input of the opamp 310. The collector terminal of the transistor 320 is connected to a point of the LED string 341, 342, 343, in this case a node between a first LED 341 and a second LED 342, with an amber LED 371 in this collector line.

Thus, in the embodiment shown, the collector-emitter path of the transistor 320 is connected in parallel to a portion of the string of white LEDs 341, 342, 343; this can be considered as constituting a total of three strings, one string containing two white LEDs 342, 343 parallel to on string containing one amber LED 371, and these two strings being connected in series to a third string containing one white LED 341. Alternatively the collector-emitter path of the transistor 320 could be connected in parallel to the entire string of white LEDs 341, 342, 343, in which case there would be only two strings. In the example, there are three white LEDs 341, 342, 343 in series, but his could be two or four or more. In this example, the collector line contains only one amber LED, but this line might contain a series arrangement of two or more amber LEDs. In general, it is preferred that the number of amber LEDs connected in series in the collector line is less than the number of series-connected white LEDs in the string parallel to the collector-emitter path of the transistor 320.

The operation is as follows. With increasing input current, the voltage drop over the current sensor resistor 350 rises, thus the voltage between input terminals 111, 112 rises, thus the voltage at the opamp's non-inverting input rises. Since the voltage drop over the string of white LEDs 341, 342, 343 is substantially constant, the voltage rise between input terminals 111, 112 is substantially equal to the rise of voltage drop over the current sensor resistor 350 while the voltage rise at the opamp's non-inverting input is smaller than the voltage rise between input terminals 111, 112, the ratio being defined by the resistors 331, 332 of the voltage divider 320. Thus, the voltage drop over the feedback resistor 360 should be reduced, and hence the current in the collector-emitter path of the transistor 320 is reduced.

Figure 3B:
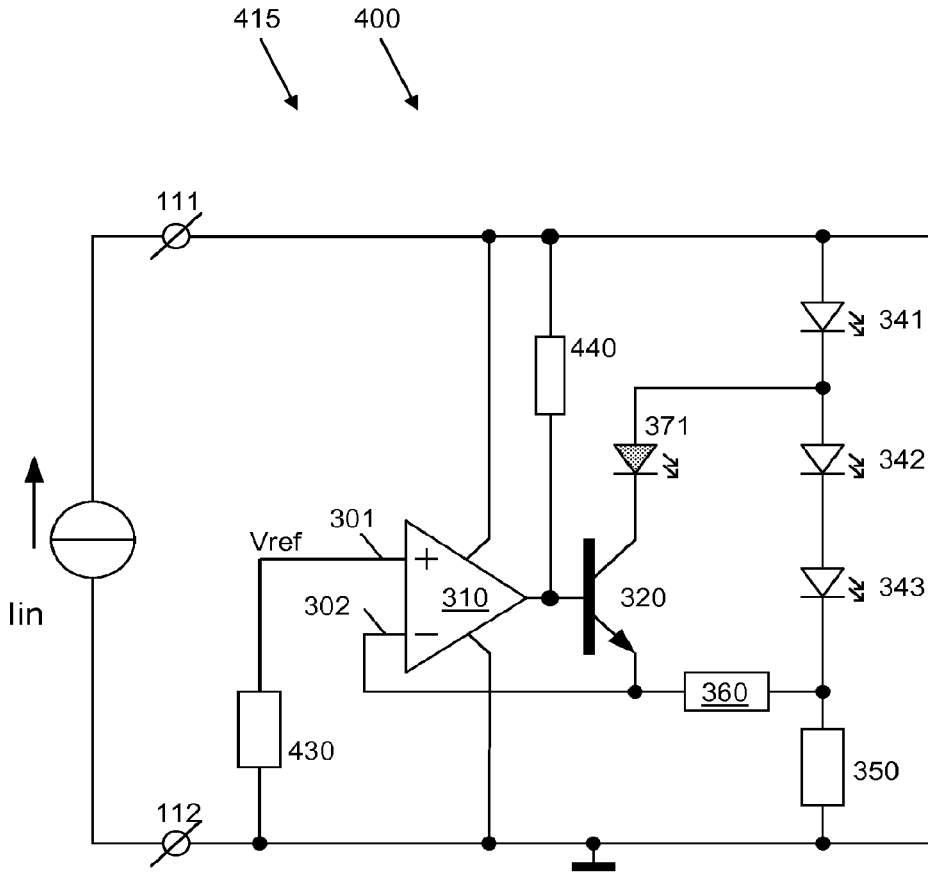
FIG. 3B is a diagram illustrating a variation of the first possible embodiment of a division circuit according to the present invention.

FIG. 3B is a diagram illustrating a second possible embodiment of the division circuit 115. This embodiment of the LED module will be indicated by reference numeral 400, and its division circuit will be indicated by reference numeral 415. The division circuit 415 is substantially identical to the division circuit 315, with the exception that the opamp 310 has its non-inverting input 301 set at a reference voltage level Vref determined by a reference voltage source 430, providing a reference voltage of for instance 200 mV, while further the base terminal of the transistor 320 is coupled to the positive input terminal 111 through a resistor 440. One important advantage of this division circuit 415 over the division circuit 315 of FIG. 3A is that it is more stable, i.e. less sensitive to variations of the forward voltages of the individual LEDs. The operation is comparable: with increasing input current, the voltage drop over the current sensor resistor 350 rises, thus the voltage at the opamp's inverting input 302 rises, reducing the base voltage of the transistor and hence reducing the current in the collector-emitter path of the transistor 320.

Figure 4A:
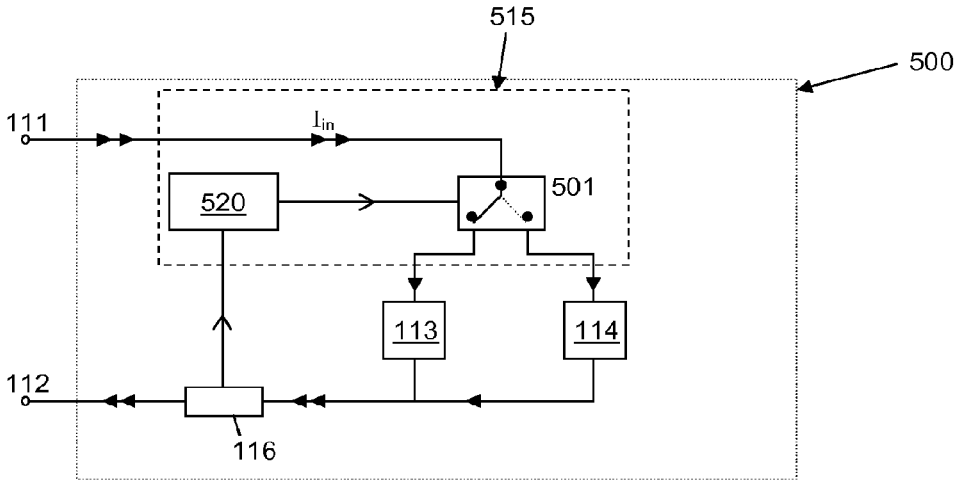
FIG. 4A is a diagram illustrating a second possible embodiment of a division circuit according to the present invention.

FIG. 4A is a block diagram, comparable to FIG. 1D, illustrating a second embodiment of an LED module 500, where the input current Iin is divided over two LED strings 113, 114 on a temporal basis. The division circuit of this embodiment will be indicated by reference numeral 515. The module 500 comprises a controllable switch 501, having an input terminal receiving the input current Iin, and having two output terminals coupled to the LED strings 113, 114, respectively. The controllable switch 501 has two operative conditions, one where the first output terminal is connected to its input terminal and one where the second output terminal is connected to its input terminal. A control circuit 520 controls the controllable switch 501 to switch between these two operative conditions at a relatively high frequency. Thus, each LED string 113, 114 receives current pulses having a certain duration t1, t2, respectively, the current pulses having magnitude Iin. If the switching period is indicated as T, the ratio t1/T determines the average current in the first LED string 113 and the ratio t2/T determines the average current in the second LED string 114, with t1+t2=T. The control circuit 520 sets the duty cycle (or ratio t1/t2) on the basis of the input current Iin as sensed by current sensor 116: if the input current level Iin decreases, t1 is reduced and t2 is increased so that the average light output of the first LED string 113 (for instance white) is reduced and the average light output of the second LED string 114 (for instance amber) is increased.

Figure 4B:
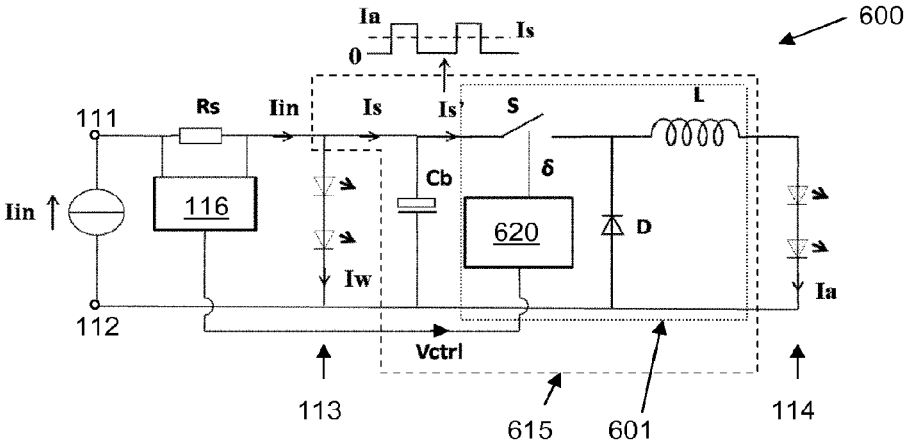
FIG. 4B is a diagram illustrating a third possible embodiment of a division circuit according to the present invention.

FIG. 4B is a block diagram illustrating a third embodiment of an LED module 600, where the amount of current in the second group of LEDs 114 (for instance amber) is controlled by a Buck current converter 601 connected in parallel to the first group of LEDs 113 (for instance white). The division circuit of this embodiment will be indicated by reference numeral 615. The first LED string 113 is connected in parallel to the input terminals 111, 112. A filter capacitor Cb is connected in parallel to the first LED string 113. The second LED string 114 is connected in series with an inductor L, with a diode D connected in parallel to this series arrangement. A controllable switch S is connected in series to this parallel arrangement, controlled by the control circuit 115, wherein a control circuit 620 sets the duty cycle 6 of the switch S on the basis of the input current Iin as sensed by current sensor 116. The resulting current in the second LED string 114 is indicated as Ia, and the resulting current in the first LED string 113 is indicated as Iw.

The Buck converter is operated in CCM (continuous conduction mode), such that the ripple in Ia is small compared to its average value. The input current Is' of the Buck converter is a switched current, having a peak value equal to Ia and a duty cycle δ. The switched current Is' is supplied from the filter capacitor Cb, and the input current Is to this filter capacitor Cb is in fact the average value of Is'. For the Buck converter operating in CCM and neglecting the current ripple, we can derive Is=δIa. It should be clear that the current in the first LED string 113 is reduced by the input current Is to the filter capacitor Cb, or $$Iw=Iin-Is=Iin-\delta Ia.$$

So, if δ is changed to adapt the amber current Ia, the current Iw through the white LED's also changes. The current source Iin has the same linear dependency on the dim setting as shown in FIG. 2A/B. The input current Iin is monitored by current sensor 116, generating a sense signal Vctrl, and the control circuit 620 changes the duty cycle δ of the Buck converter, and as such changes both the currents Iw and Ia.

In principle, the same white/amber current divisions as shown in FIG. 2A/B can be realized with this embodiment. The advantage compared to the other embodiments is the higher efficiency. The Buck converter inherently has a higher efficiency than a linear current regulator, as the other embodiments of FIGS. 3A-3B in fact are. Also, via a suitable current sense network (pre-biased current mirror), the sense resistor Rs can be kept very small.

It is noted that the Buck converter regulating the amber LED current Ia is preferably a hysteretic mode controlled Buck converter.

Figure 5:
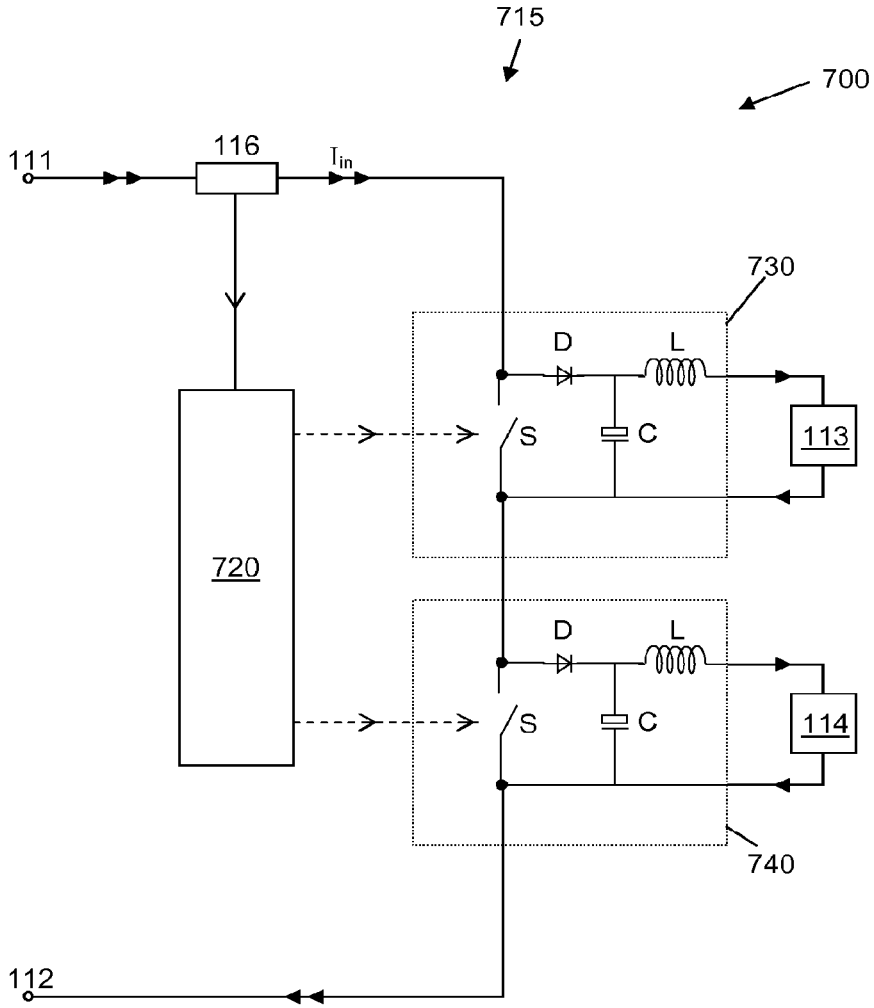
FIG. 5 is a diagram illustrating a fourth possible embodiment of a division circuit according to the present invention.

FIG. 5 is a block diagram illustrating a fourth embodiment of an LED module 700, where each individual LED string 113, 114 is driven by a corresponding current converter 730, 740, respectively. The division circuit of this embodiment will be indicated by reference numeral 715. In this case, the two current converters 730, 740 are connected in series. In the embodiment shown, the converters are depicted as being of Buck type, but it is noted that different types are also possible, for instance boost, buck-boost, sepic, cuk, zeta. A control circuit 720 has two control output terminals, for individually controlling the switches S of the converters, on the basis of the input current Iin as sensed by the current sensor 116. Each current converter 730, 740 generates an output current depending on the duty cycle of the switching of the corresponding switch S, as should be clear to a person skilled in the art. In this embodiment, it is possible for the control circuit 720 to implement the same current dependency as shown in FIGS. 2A-2B, but it is also possible to control the individual currents for the individual LED strings 113, 114 independently from each other; so, in fact, it is possible for both LED strings 113, 114 to be driven at maximum light output or at minimum light output simultaneously.

It is also possible to obtain the desired behavior on the basis of intrinsic characteristics of the LEDs itself.

Figure 6:
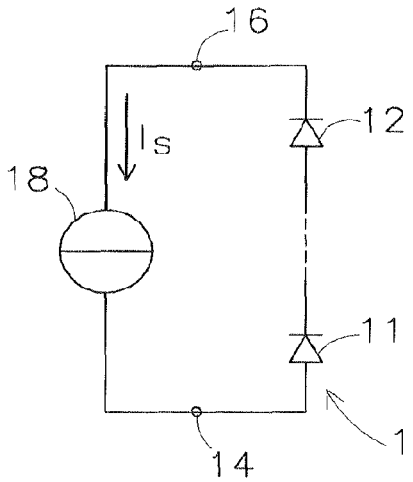
FIG. 6 depicts an LED lighting device in a fifth embodiment of the present invention, powered by a current source.

FIG. 6 depicts a lighting device 1 comprising at least one LED 11 of a first type, such as an AlInGaP type LED, and producing light having a first color temperature. The at least one LED 11 is connected in series with at least one LED 12 of a second type different from the first type, such as an InGaN type LED, and producing light having a second color temperature which is higher than the color temperature of an AlInGaP type LED. The lighting device 1 has two terminals 14, 16 for supplying a current IS from a current source 18 to the series connection of LEDs 11, 12. The lighting device 1 has no active components. As indicated by a dashed line, the series connection LEDs of the lighting device 1 may comprise further LEDs 11 of the first type and/or LEDs 12 of the second type, such that the lighting device 1 comprises a plurality of LEDs 11 of the first type and/or a plurality of LEDs 12 of the second type. The lighting device 1 may further comprise one or more of any other type of LEDs of a third type different from the first type and the second type.

The one or more LEDs 11 of the first type are selected to have a first luminous flux output as a function of temperature having a gradient which is different from the gradient of a second luminous flux output as a function of temperature of the one or more LEDs 12 of the second type. In practice, the luminous flux output FO variation may be characterized by a so-called hot-coldfactor, indicating a percentage of luminous flux loss from 25° C. to 100° C. junction temperature of the LED. This is illustrated by reference to FIGS. 7, 8 and 9.

Figure 7:
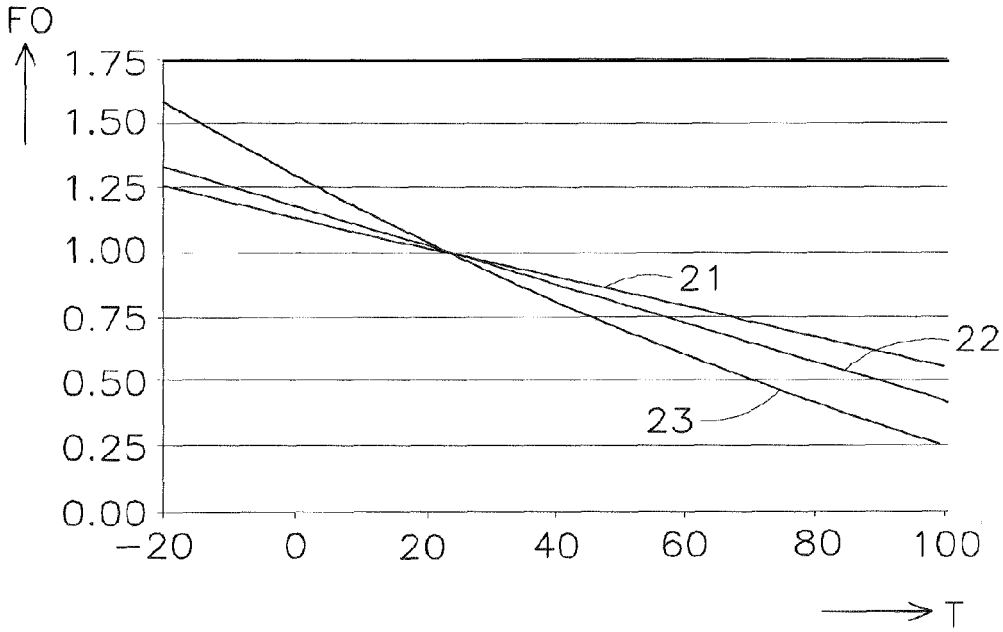
FIG. 7 illustrates relationships between luminous flux and temperature for different types of LEDs.

FIG. 7 illustrates graphs of a luminous flux output FO (vertical axis, lumen/mW) as a function of temperature T (horizontal axis, ° C.) of different LEDs 11 of a first type. A first graph 21 illustrates a luminous flux output FO decrease at a temperature increase for a red photometric LED. A second graph 22 illustrates a steeper luminous flux output FO decrease than the graph 21 at a temperature increase for a red-orange photometric LED. A third graph 23 illustrates a still steeper luminous flux output FO decrease than the graphs 21 and 22 at a temperature increase for an amber photometric LED.

Figure 8:
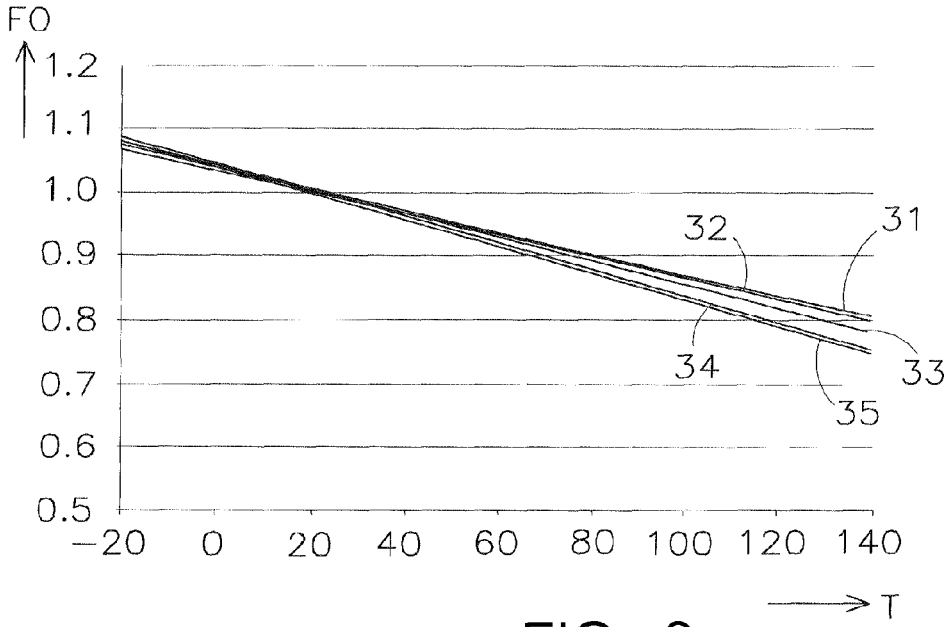
FIG. 8 illustrates further relationships between luminous flux and temperature for different types of LEDs.

FIG. 8 illustrates graphs of a luminous flux output FO (vertical axis, lumen/mW) as a function of temperature T (horizontal axis, ° C.) of different LEDs 12 of a second type. A first graph 31 illustrates a luminous flux output FO decrease at a temperature increase for a cyan photometric LED. A second graph 32 illustrates a slightly steeper luminous flux output FO decrease than the graph 31 at a temperature increase for a green photometric LED. A third graph 33 illustrates a still steeper luminous flux output FO decrease than the graphs 31 and 32 at a temperature increase for a royal-blue radiometric LED. A fourth graph 34 illustrates a yet steeper luminous flux output FO decrease than the graphs 31, 32 or 33 at a temperature increase for a white photometric LED. A fifth graph 35 illustrates a still slightly steeper luminous flux output FO decrease than the graphs 31, 32, 33 or 34 at a temperature increase for a blue photometric LED.

FIGS. 7 and 8 show that an LED 11 of a first type has a higher hot-coldfactor than an LED 12 of a second type, indicating that the gradient of the luminous flux output as a function of temperature of the LED 11 is higher than the gradient of the luminous flux output as a function of temperature of the LED 12.

Figure 9:
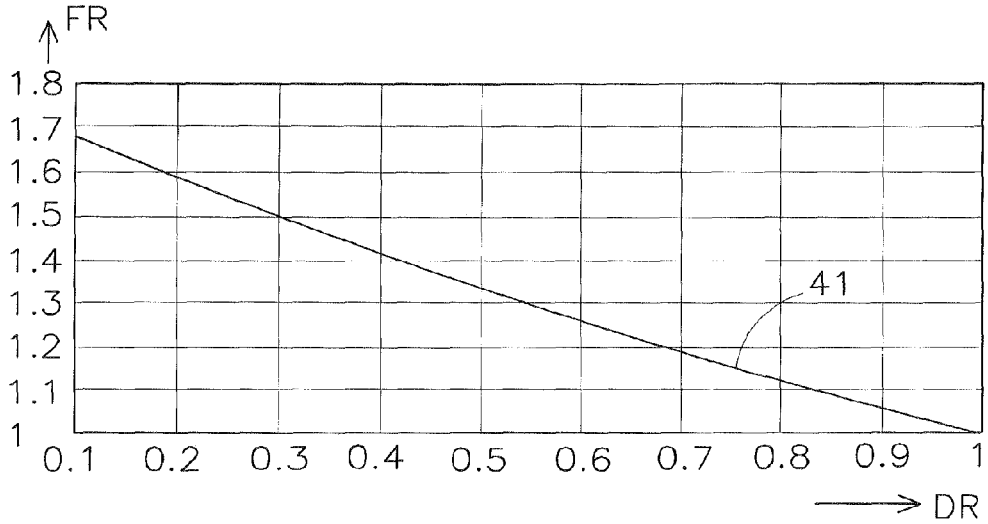
FIG. 9 illustrates a relationship between a luminous flux ratio and a dimming ratio for different types of LEDs.

FIG. 9 illustrates a graph 41 of a luminous flux output ratio FR (vertical axis, dimensionless) of a string of LEDs 11 of the first type (red, orange, amber) having a relatively low color temperature, and a string of LEDs 12 of the second type (cyan, blue, white) having a relatively high color temperature, as a function of a dimming ratio DR (horizontal axis, dimensionless), where the temperature of all LED dies is 100° C. at 100% power (no dimming, i.e. dimming ratio=1), and ambient temperature is 25° C. The graph 41 illustrates a luminous flux output ratio FR decrease at a dimming ratio increase. Thus, according to FIG. 9, a lighting device 1 having the luminous flux ratio of the first and second sets of LEDs as shown will show a color temperature decrease when the lighting device 1 is dimmed. A particular luminous flux output ratio at a particular dimming ratio may be designed without undue experimentation by selecting appropriate types of LEDs in appropriate amounts, and selecting an appropriate thermal resistance to ambient of each LED of set of LEDs to obtain desired temperatures for the LED at particular dimming ratios. For example, the one or more LEDs of the first type, such as AlInGaP LEDs, may be mounted with a higher thermal resistance to ambient than the one or more LEDs of the second type, such as InGaN LEDs. In an appropriate design, the LED lighting device 1 will show a color temperature behavior like a color temperature behavior of an incandescent lamp, without additional controls.

Figure 10:
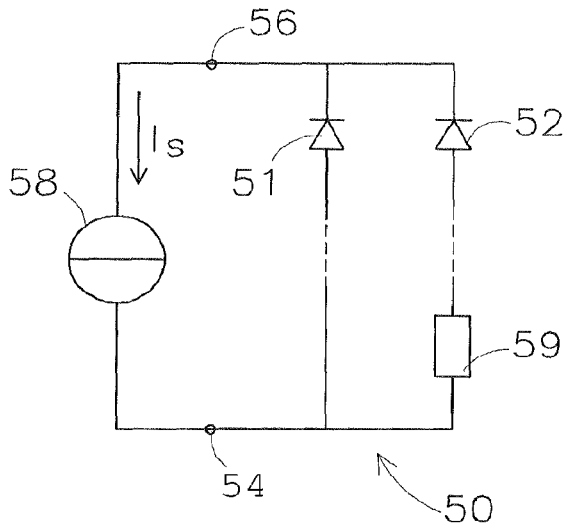
FIG. 10 depicts a LED lighting device in a sixth embodiment of the present invention, powered by a current source.

FIG. 10 depicts a lighting device 50 comprising at least one LED 51 of a first type, such as an AlInGaP type LED, connected in parallel with at least one LED 52 of a second type different from the first type, such as an InGaN type LED. The lighting device 50 has two terminals 54, 56 for supplying a current IS from a current source 58 to the parallel connection of LEDs 51, 52. In series with the at least one LED 52, a resistor 59 is provided. The resistor 59 may also be connected in series with the at least one LED 51 instead of in series with the at least one LED 52. Alternatively, a resistor may be connected in series with the at least one LED 51 and another resistor may be connected in series with the at least one LED 52. The lighting device 50 has no active components. As indicated by dashed lines, the at least one LED 51 and the at least one LED 52 of the lighting device 50 may comprise further LEDs 51 and/or 52 such that the lighting device 50 comprises a plurality of LEDs 51 of the first type and/or a plurality of LEDs 52 of the second type. The lighting device 50 may further comprise one or more of any other type of LEDs of a third type different from the first type and the second type.

The resistor 59 is a negative temperature coefficient, NTC, type resistor, which will compensate relatively slow temperature variations by the variation of its resistance value.

The one or more LEDs 51 of the first type are selected to have a first dynamic resistance (measured as a ratio of a forward voltage across the LED(s) and a current through the LED(s)) which is different from a second dynamic resistance of the one or more LEDs 52 of the second type connected in series with the resistor 59. As a result, a ratio of the current through the one or more LEDs 51 of the first type and the current through the one or more LEDs 52 will be variable. This is illustrated by reference to FIG. 11.

Figure 11:
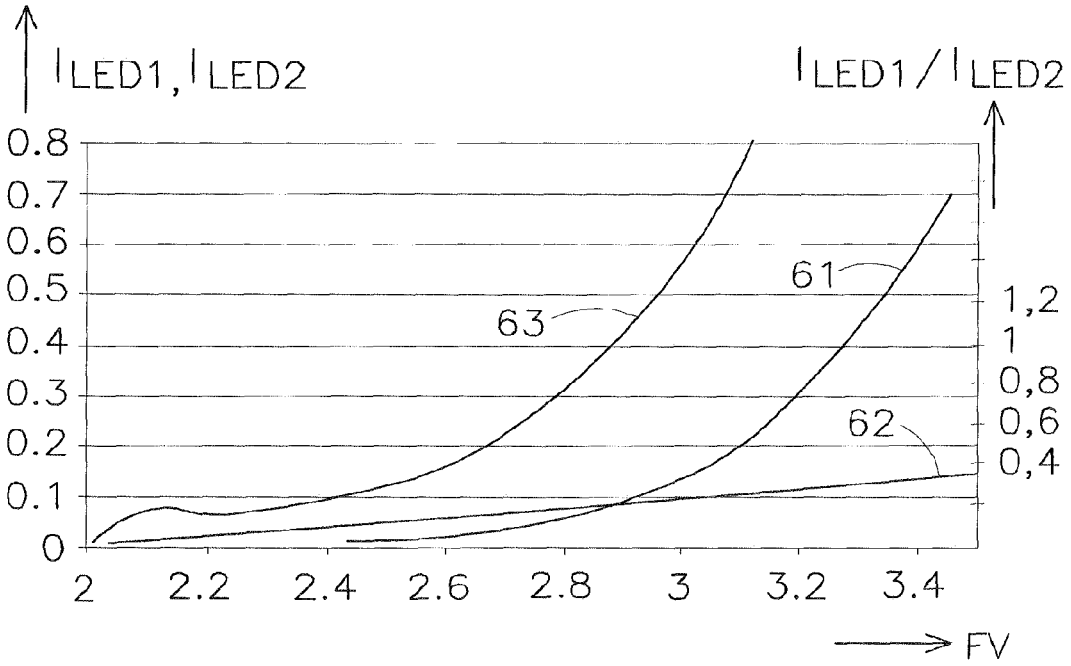
FIG. 11 illustrates relationships between LED current and forward voltage for different types of LEDs, as well as a ratio of current through the first and second sets of LEDs of FIG. 10.

FIG. 11 illustrates graphs of currents ILED1, ILED2 (left vertical axis, A) as a function of forward voltage FV (horizontal axis, V) for LED(s) of a first and second type. Referring also to FIG. 10, a first graph 61 illustrates a current ILED1 in InGaN LED(s) 51 as a function of forward voltage across the LED(s) 51. A second graph 62 illustrates a current ILED2 in AlInGaP LED(s) 52 and resistor 59 as a function of forward voltage across the LED(s) 52 and resistor 59. In the illustrated example, the resistor 59 has a value of 8 ohm.

FIG. 11 further shows a graph 63 of the current ratio ILED1/ILED2 (right vertical axis, dimensionless) as a function of forward voltage FV. As can be seen in graph 63, for forward voltages FV higher than ca. 2.9 V, a higher current ILED1 flows through the LED(s) 51 than the current ILED2 through the LED(s) 52 and resistor 59, whereas below a forward voltage FV of about 2.9 V, the current ILED1 is lower than ILED2. Accordingly, when the current provided by the current source 58 is lowered in a dimming operation, the luminous flux output from the LED(s) 51, will decrease at a higher rate than the decrease of the luminous flux output from the LED(s) 52, such that the color temperature of the lighting device 50 will tend more towards the color temperature of the LED(s) 52 than at a higher current provided by the current source 58, where the color temperature of the lighting device 50 will tend towards the color temperature of the LED(s) 51. In an appropriate design, the LED lighting device 50 will thus show a color temperature behavior like a color temperature behavior of an incandescent lamp, without additional controls.

The current sources 18, 58 are configured to provide a DC current which may have a low current ripple. For dimming purposes, the current sources 18, 58 may be pulse width modulated. In case of the current source 18 feeding the lighting device 10, the junction temperatures of the LEDs will decrease when dimming. In case of current source 58, the average current during the time that a current flows in the lighting device 50, should be decreased during dimming. Thus, each current source 18, 58 is to be considered as a dimmer having output terminals which are adapted to provide a variable electrical power, in particular a variable current, and the terminals 14, 16 and 54, 56, respectively, are configured to be connected to the output terminals of the dimmer.

In the above it has been explained that in a lighting device sets of LEDs are employed using the natural characteristics of the LEDs to resemble incandescent lamp behavior when dimmed, thereby obviating the need for sophisticated controls. A first set of at least one LED produces light with a first color temperature, and a second set of at least one LED produces light with a second color temperature. The first set and the second set are connected in series, or the first set and the second set are connected in parallel, possibly with a resistive element in series with the first or the second set. The first set and the second set differ in temperature behavior, or have different dynamic electrical resistance. The light device produces light with a color point parallel and close to a blackbody curve.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting, but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language, not excluding other elements or steps). Any reference signs in the claims should not be construed as limiting the scope of the claims or the invention.

The mere fact that certain measures are recited in mutually different dependent claims does not indicate that a combination of these measures cannot be used to advantage.

The term coupled, as used herein, is defined as connected, although not necessarily directly, and not necessarily mechanically.

Summarizing, in a lighting device, the present invention provides that sets of LEDs are employed using the natural characteristics of the LEDs to resemble incandescent lamp behavior when dimmed, thereby obviating the need for sophisticated controls. A first set of at least one LED produces light with a first color temperature, and a second set of at least one LED produces light with a second color temperature. The first set and the second set are connected in series, or the first set and the second set are connected in parallel, possibly with a resistive element in series with the first or the second set. The first set and the second set differ in temperature behavior, or have different dynamic electrical resistance. The light device produces light with a color point parallel and close to a blackbody curve.

The present invention also relates to a lighting kit of parts, comprising:

a dimmer having input terminals adapted to be connected to an electrical power supply, and having output terminals adapted to provide a variable electrical power; and a lighting device according to any of the attached claims, wherein the terminals of the lighting device are configured to be connected to the output terminals of the dimmer.

While the invention has been illustrated and described in detail in the drawings and foregoing description, it should be clear to a person skilled in the art that such illustration and description are to be considered illustrative or exemplary and not restrictive. The invention is not limited to the disclosed embodiments; rather, several variations and modifications are possible within the protective scope of the invention as defined in the appending claims.

For instance, different colors can be used. For instance, instead of amber, it would be possible to use yellow or red. Further, it is noted that in the example the contribution of the white LEDs reduces to zero with reducing input current, but this is not necessary.

Further, while in the above the driver 101 has been described as being capable of receiving dimmed mains from a dimmer 9, it is also possible that the driver 101 is designed for being dimmed by remote control while receiving normal mains voltage. The important aspect is that the driver 101 is acting as a current source and is capable of generating dimmed output current, which is received by the LED module as input current. Thus, the light output level is determined by the driver 101 by generating a certain output current to the LED module, and the color of the light output is determined by the LED module in dependency of the current received from the driver 101.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

In the above, the present invention has been explained with reference to block diagrams, which illustrate functional blocks of the device according to the present invention. It is to be understood that one or more of these functional blocks may be implemented in hardware, where the function of such functional block is performed by individual hardware components, but it is also possible that one or more of these functional blocks are implemented in software, so that the function of such functional block is performed by one or more program lines of a computer program or a programmable device such as a microprocessor, microcontroller, digital signal processor, etc.

The invention claimed is:

1. Lighting device, comprising:

an LED driver capable of generating dimmed LED current;

a two-terminal LED module, having two input terminals for receiving an input current (Iin) from the LED driver and comprising:

a first LED group comprising at least one first type LED for producing light having a first color temperature;

a second LED group comprising at least one second type LED for producing light having a second color temperature different from the first color temperature;

wherein the LED module is capable of supplying LED currents to the LED groups, these LED currents being derived from the input current (Iin);

wherein the LED module produces a light output having at least a light output contributions from the first LED group and from the second LED group;

wherein the module is designed to vary the individual LED currents in the individual LED groups in dependency of the average magnitude of the received input current (Iin), such that the color point of the light output of the module varies as a function of the input current magnitude;

each of the LED modules including an electronic division circuit capable of controlling a ratio of the LED currents in the first and second LED groups as a function of the input current level retrieved at the input of the LED module;

wherein the electronic division circuit comprises a controllable switch for temporally dividing the received input current (Iin) between the two groups of LEDs;

a control device for controlling the switch at a switching period T such that the input current is passed on to the first group of LEDs for a first time duration t1 and the input current is passed on to the second group of LEDs for a second time duration t2, with t1+t2=T;

a current sensing element arranged for sensing the input current received at the input terminals of the module;

the control device being coupled to receive a sense output signal from the sensing element and being designed to vary the ratio t1/t2 of the switching of the switch on the basis of said sense output signal, such that there is at least a range of input current magnitudes where dt1(Iin) is always positive and dt2(Iin) is always negative.

2. Lighting device according to claim 1, wherein the LED module is designed to vary the individual LED currents in the individual LED groups such that the color point of the light output of the module on dimming follows a black body curve.

3. Lighting device according to claim 1, wherein the LED module is designed to vary the individual LED currents in the individual LED groups such that the color behavior of the light output of the module on dimming resembles the color behavior of an incandescent lamp.

4. Lighting device according to claim 1, wherein the lighting device is configured to produce light with a color temperature CT at an average current of x %, CT(x %), supplied to the terminals following the relationship:

$$CT(x\%)=CT(100\%)*(x/100)1/9.5.$$

5. Lighting device according to claim 1, wherein the first group of LEDs has a varying first luminous flux output as a function of junction temperature of the first type LED, and the second group of LEDs has a varying second luminous flux output as a function of junction temperature of the second type LED, and wherein, at varying junction temperatures, the ratio of the first luminous flux output to the second luminous flux output varies;

and wherein the first color temperature is lower than the second color temperature, while, at decreasing junction temperatures, the ratio of the first luminous flux output to the second luminous flux output increases.

6. Lighting device according to claim 1, wherein a gradient of the first luminous flux output as a function of junction temperature of the first type LED differs from a gradient of the second luminous flux output as a function of junction temperature of the second type LED;

and wherein the first color temperature is lower than the second color temperature, while the absolute value of the gradient of the first luminous flux output as a function of temperature of the first type LED is higher than the gradient of the second luminous flux output as a function of temperature of the second type LED.

7. Lighting device according to claim 1, wherein a thermal resistance to ambient of the first group of LEDs differs from the thermal resistance to ambient of the second group of LEDs;

and wherein the first color temperature is lower than the second color temperature, while the thermal resistance to ambient of the first group of LEDs is higher than the thermal resistance to ambient of the second group of LEDs.

8. Lighting device according to claim 1, wherein the first group of LEDs has a first dynamic electrical resistance, and the second group of LEDs has a second dynamic electrical resistance.

9. Lighting device according to claim 1, wherein one of the first group of LEDs and the second group of LEDs is connected in series with a resistor, and wherein this series arrangement is connected in parallel to the other one of the first group of LEDs and the second group of LEDs, and wherein this parallel arrangement is connected between the two input terminals of the LED module;

and wherein the resistor is a negative temperature coefficient, NTC type resistor.

10. Lighting device according to claim 1, wherein the LED module comprises:

a current regulating element arranged in series with one of said group of LEDs, this series arrangement being coupled in parallel to another of said groups of LEDs;

a current sensing element arranged for sensing the input current received at the input terminals of the LED module;

and a regulator driver receiving a sense output signal from the sensing element and driving the current regulating element on the basis of this sense output signal.

11. Lighting device according to claim 1, wherein the second group of LEDs is supplied by a current converter having its input terminals connected in parallel to the first group of LEDs;

wherein the current converter comprises a control circuit receiving a sense output signal from a current sensing element sensing the input current of the LED module;

and wherein this control circuit is designed to control the current converter on the basis of the sense output signal received from the current sensing element.

12. Lighting device according to claim 1, wherein the first group of LEDs is supplied by a first current converter and the second group of LEDs is supplied by a second current converter, and wherein these two current converter have their input terminals connected in series;

wherein the LED module comprises a control circuit receiving a sense output signal from a current sensing element sensing the input current of the LED module;

and wherein this control circuit is designed to control the current converters on the basis of the sense output signal received from the current sensing element.

* * * * *